US005376922A

United States Patent [19]

Kiss

[11] Patent Number: 5,376,922

[45] Date of Patent: Dec. 27, 1994

[54] WIRELESS BISTATIC LINK INTRUSION DETECTION SYSTEM

[76] Inventor: Michael Z. Kiss, 418 S. Meadows Ave., Manhattan Beach, Calif. 90266

[21] Appl. No.: 970,082

[22] Filed: Nov. 2, 1992

Related U.S. Application Data

[63] Continuation-in-part of Ser. No. 588,948, Sep. 26, 1990, Pat. No. 5,160,915.

[51] Int. Cl.[5] ..... G08B 13/18

[52] U.S. Cl. ..... 340/552; 340/553; 340/518; 340/541; 340/825.11

[58] Field of Search ..... 340/552, 553, 554, 518, 340/541, 825.11

[56] References Cited

U.S. PATENT DOCUMENTS 4,358,756 11/1982 Morel ..... 340/554 X
4,605,922 8/1986 Blattman ..... 340/552
4,964,065 10/1990 Hicks ..... 340/552 X

*Primary Examiner*—Hezron E. Williams
*Assistant Examiner*—Christine K. Oda
*Attorney, Agent, or Firm*—Freilich Hornbaker Rosen

[57] ABSTRACT

An intrusion detection system employing multiple bistatic microwave links and wireless means for remotely interrogating each link to provide alarm and status information at a central station. The central station includes a microprocessor for remotely adjusting the operating parameters of the microwave transmitters and receivers forming said links to increase the probability of intrusion detection and reduce the probability of false alarms.

10 Claims, 11 Drawing Sheets

24

WIRELESS BISTATIC LINK INTRUSION DETECTION SYSTEM

RELATED APPLICATIONS

This application is a continuation-in-part of U.S. application Ser. No. 588,948 filed Sep. 26, 1990, now U.S. Pat. No. 5,160,915 issued Nov. 3, 1992, whose disclosure is by reference incorporated herein.

FIELD OF THE INVENTION

This invention relates generally to intrusion detection systems using multiple bistatic detectors.

BACKGROUND OF THE INVENTION

Various bistatic intrusion detectors exist for detecting the intrusion of persons or equipment across a line; e.g. a border or area perimeter. Exemplary detectors are discussed in the following U.S. Pat. Nos.

2,203,807
3,237,105
3,618,083
3,618,091
3,696,368
3,877,002
4,605,922
4,697,184

A bistatic detector is comprised of a microwave transmitter and receiver, which, when deployed, are typically spaced from one another by several hundred feet. Processor means monitors the microwave energy received by the receiver and interprets a signal variation greater than a certain threshold as constituting an intrusion or alarm condition.

Applicant's parent application describes an intrusion detection system employing multiple bistatic links and wireless means for remotely interrogating each link to provide alarm information at a central station. The preferred embodiment described therein includes a plurality of identical sector sets, each forming a pair of bistatic microwave links. Each sector set is comprised of a sector module and first and second transmit modules which together form left and right bistatic links. The sector module includes oppositely oriented first and second receive antennas and supporting electronics. Each of the sector and transmit modules is physically configured so as to be readily remotely deployed, each module including a self contained battery and solar charging panel. In operation, each transmit module transmits a microwave carrier with encoded status information over its link to the associated sector control module. The status information is indicative of operating conditions (i.e. normal or fault) at the transmit module such as tampering, low battery voltage, etc. The transmitted carrier and status information is received at the sector module and processed and decoded to yield both alarm and status data.

SUMMARY OF THE INVENTION

The present invention is directed to an improved intrusion detection system in which the operating parameters of the sector and transmit modules can be controlled by radio frequency (preferably UHF) transmissions from the central station. More particularly, in accordance with a preferred embodiment, the transmit and receive parameters of the sector set modules (e.g. microwave frequency, receiver sensitivity (threshold), filter functions, power output, etc.) are microprocessor controlled by RF transmissions from the central station.

In accordance with a preferred system embodiment, the central station uses time division multiplexing (TDM) to sequentially enable the multiple microwave links. When enabled, a transmit module transmits a data burst on a microwave carrier which includes the aforementioned status information. The data burst is used, amongst other things, to derive a bit error rate (B.E.R.) for the link. The B.E.R. data is in turn used to derive link condition data indicative of environmental conditions, e.g., rain, sandstorm, etc. This link condition data is used by the central station to adapt or fine tune the microwave link by adjusting the aforementioned transmit and receive parameters (i.e. frequency, sensitivity, filter functions, power output, etc. ) to achieve optimal link performance.

In accordance with a further aspect of the preferred embodiment, pulse code modulation (PCM) of the microwave carrier is used to transmit link data, and multiple pulses are utilized to reduce the signal-to-noise (S/N) ratio required to yield a satisfactory probability of detection (Pd) and probability of false alarm (Pfa). Exemplary values of Pd and Pfa for an embodiment of the present invention are on the order of Pd=99% and Pfa=$10^{-6}$. In contrast to using a single pulse, the use of multiple pulses and pulse integration allows a lower S/N to be tolerated while still yielding the target Pd and Pfa values.

In accordance with a further aspect of the preferred embodiment, the B.E.R. for a link is derived by recursive averaging, to thus yield a normalized local terrain reference which masks or compensates for existing typographical features. More particularly, this averaged B.E.R. is preferably compared to stored computer profiles to minimize the incidence of false alarms.

DETAILED DESCRIPTION

Figure 1:
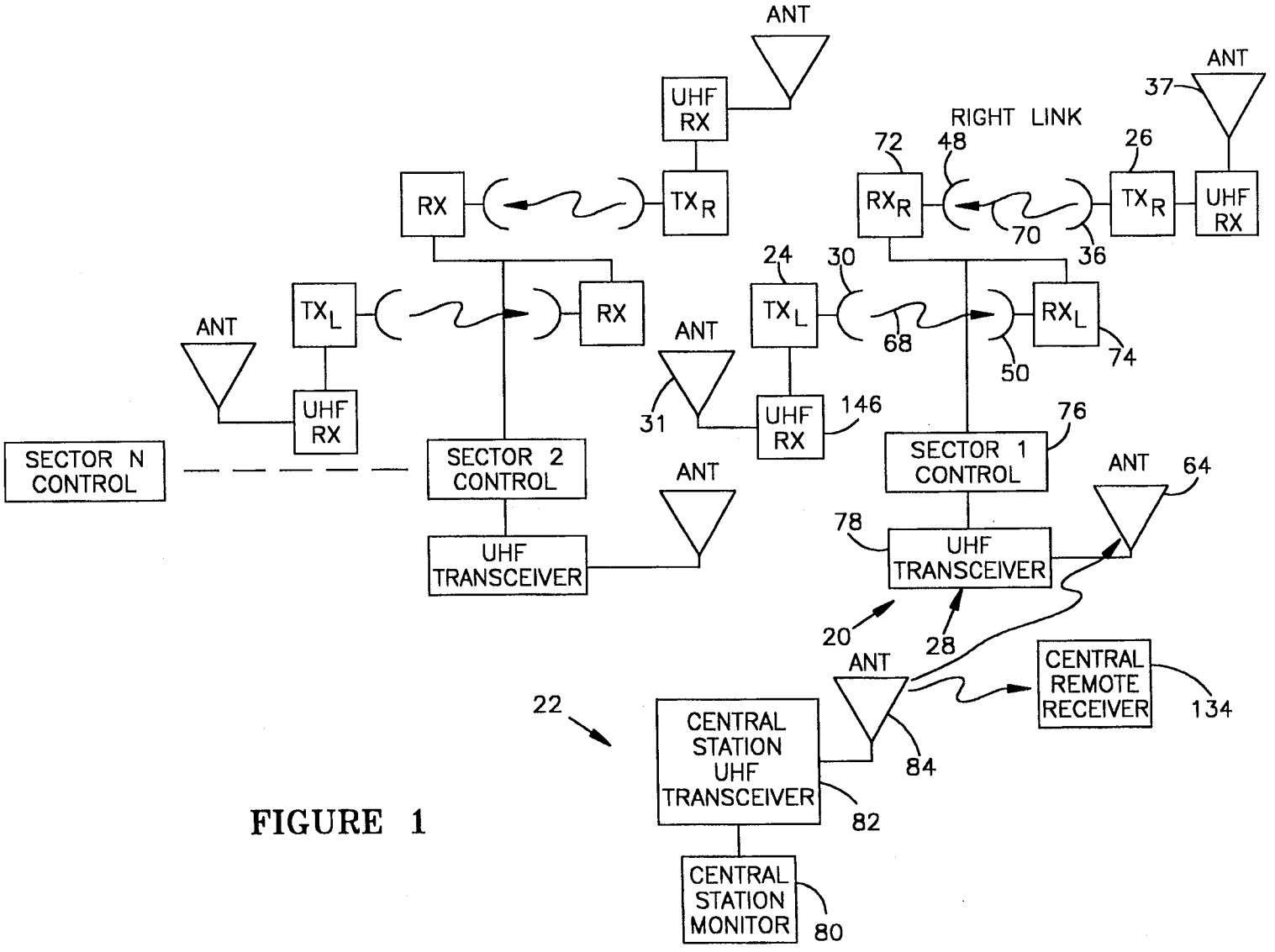
FIG. 1 is a block diagram of an intrusion detection system in accordance with the invention comprised of multiple sector sets and a central control station set.

Attention is initially directed to FIG. 1 which comprises a block diagram of a preferred wireless intrusion detection system in accordance with the invention. The system is comprised of a plurality (1,2, - - - N) of identical sector sets 20 and a central station 22 for interrogating, calibrating, and monitoring the sector sets.

Each sector set is comprised of three physical modules, namely a first (or left) transmit module 24, a second (or right) transmit module 26 and a sector module 28 which includes left and right receiver sections. Whereas FIG. 1 depicts the sector set 20 in block diagram form, FIG. 3 better illustrates the physical configuration of a preferred sector set in accordance with the present invention. More specifically, the transmit module 24 is comprised of a microwave transmit antenna 30 and a radio frequency (RF), preferably UHF, receiver antenna 31, both connected via electric cable to supporting electronics housed in cabinet 32 bearing solar panel 34. Similarly, transmit module 26 includes transmit antenna 36 and RF antenna 37 connected to cabinet 40 bearing solar panel 42. Systems in accordance with the invention are intended for use in rapid deployment situations and consequently, antenna 30,31 and 36,37 in FIG. 3 are preferably respectively mounted on portable collapsible tripods 44,46.

The sector module 28 is comprised of first and second microwave receive antennas 48,50, respectively mounted on portable collapsible tripods 52,54. The receive antennas 48,50 are respectively connected via electric cables to supporting electronics within cabinet 60, bearing solar panel 62. The sector module 28 additionally includes a radio frequency (RF), preferably UHF, transceiver antenna 64 mounted on tripod 65 and connected by cable to supporting electronics in cabinet 60.

Figure 3:
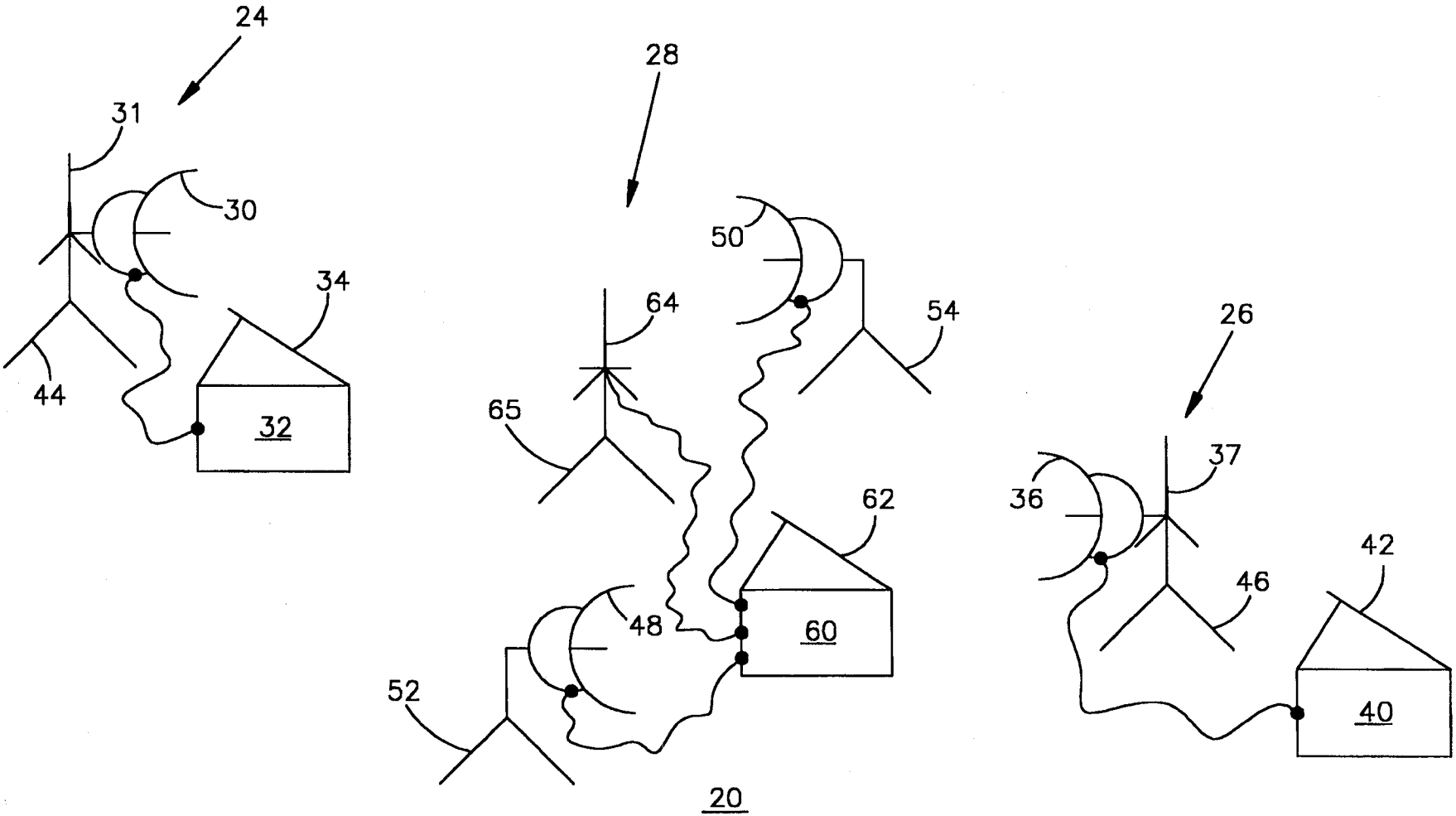
FIG. 3 schematically depicts a preferred sector set in accordance with the invention showing its sector control module and first and second transmit modules.

With reference to FIGS. 1 and 3, note that transmit antenna 30 is oriented toward receive antenna 50 to define a first (left) microwave link 68. Similarly, transmit antenna 36 is oriented toward receive antenna 48 to define a second (right) microwave link 70.

In a preferred installation for monitoring intrusion of persons or equipment across a boundary or perimeter line, (hereinafter sometimes referred to as a detection boundary) the microwave receive and transmit antennas shown in FIGS. 1 and 3 are located substantially along the boundary to be monitored. Preferably, the links, e.g. 68,70 (FIG. 1) overlap along the detection boundary to assure contiguous link to link coverage.

Figure 5:
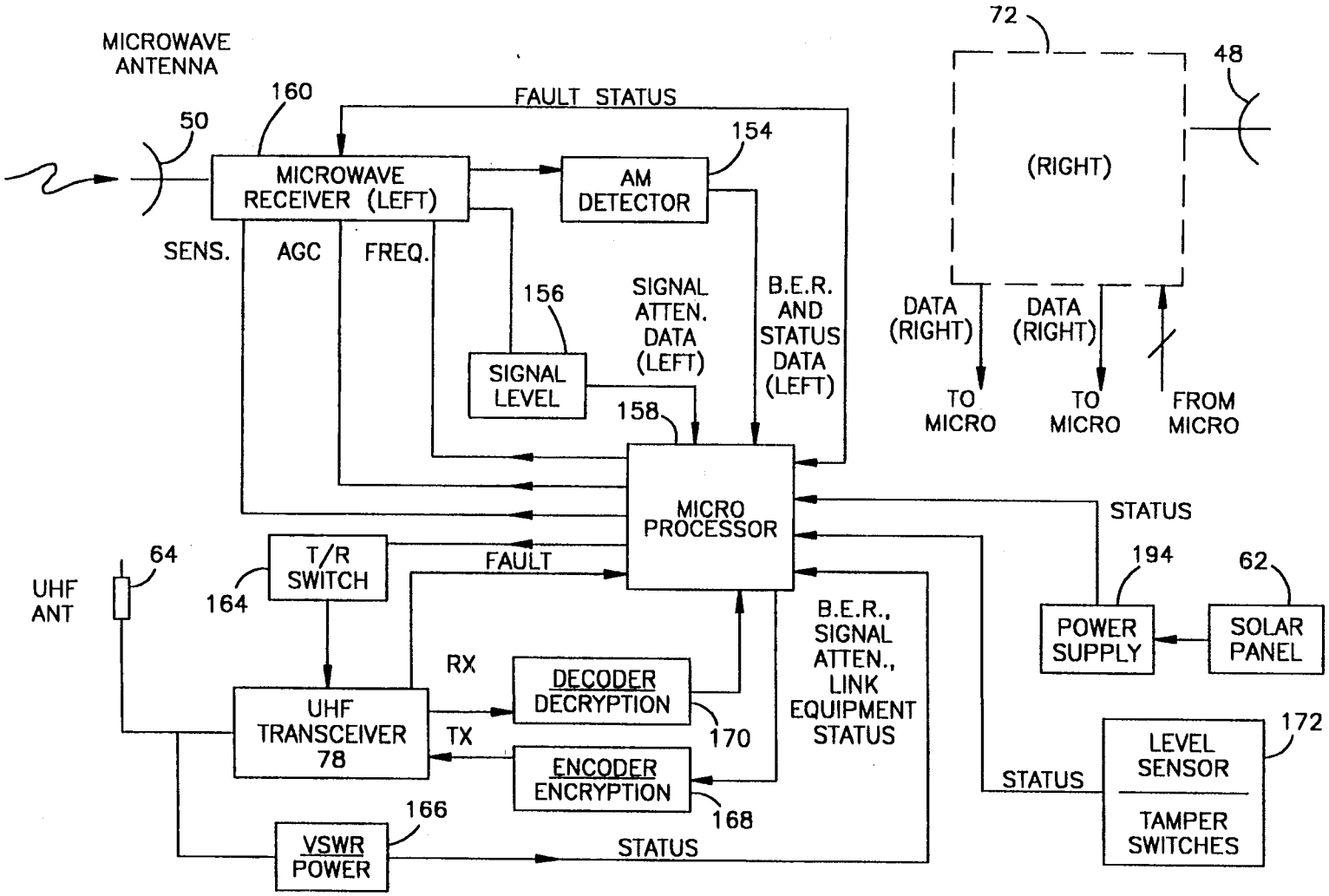
FIG. 5 is a block diagram of a preferred sector module.

With continuing reference to FIG. 1, note that the sector module 28 includes first and second receiver sections 72,74 respectively connected to the aforementioned receive antennas 48 and 50. Additionally, the sector module 28 includes a sector control section 76 which serves both receive section 72,74. The receive sections 72,74 and sector control section 76, which are all housed within cabinet 60, will be discussed in greater detail hereinafter in connection with FIG. 5.

The sector control section 76 is connected to UHF antenna 64 via UHF transceiver 78 (also physically housed in cabinet 60). As will be seen hereinafter, the function of transceiver 78 and antenna 64 is to communicate with central station 22 which preferably includes a cathode ray tube (CRT) monitor 80 having an associated key board and/or mouse 81, a UHF transceiver 82, and a UHF antenna 84.

A system in accordance with the invention, as depicted in FIG. 1, functions to monitor the intrusion of persons and equipment across the line formed by the microwave links (e.g. 68,70) defined between microwave coupled receive and transmit antennas. Processor means to be discussed hereinafter in connection with FIG. 4, responds to a variation in the microwave signal received along a link to indicate an intrusion alarm. When interrogated by central station 22, the alarm information is transmitted to the central station via UHF antennas 64,84. As will be seen hereinafter, link status information (i.e. normal or fault) is transmitted along with the alarm information to central station 22. Such status information indicates the operational status, e.g. tampering, low battery voltage, etc. with respect to the transmit modules 24,26 the receive sections 72,74 and the control section 76 of the sector module 28.

Figure 2A:
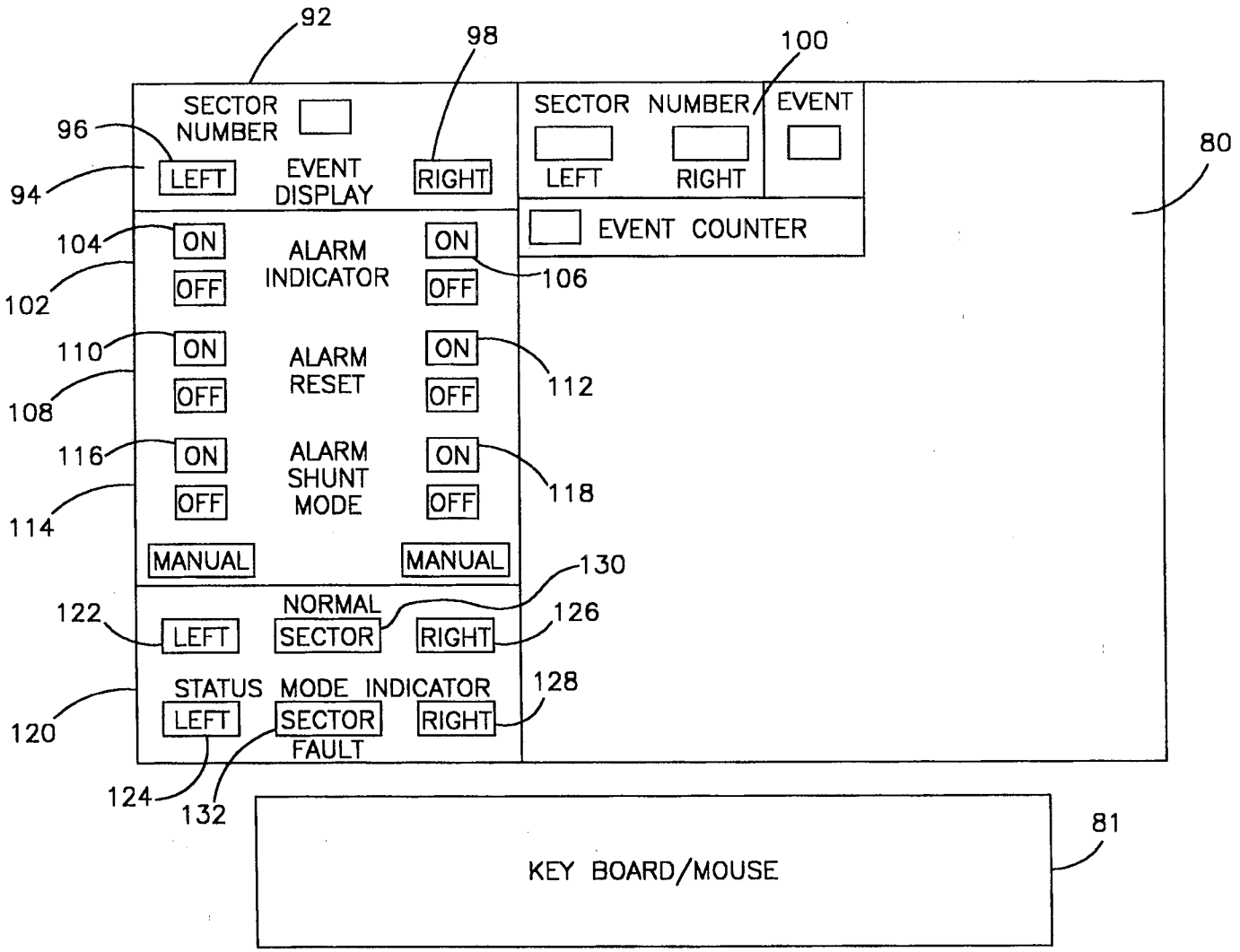
FIG. 2A schematically depicts a preferred central station CRT monitor display and FIG. 2B schematically depicts a preferred central station remote receiver display panel.

By using well known computer graphics technology, the alarm and status information received from the multiple sector sets 20 is visually displayed on the CRT monitor 80 as depicted in FIG. 2A. An exemplary display dedicated to sector set 1 is shown in FIG. 2A. Note, that cell 94 of this panel includes left and right mouse-activated switches 96,98 which, when activated, cause a number to be presented on the monitor screen partition 100 representative of the number of intrusions or alarms accumulated with respect to the associated microwave link, 68 or 70.

Cell 102 of sector panel 92 includes left and right graphic indicators 104,106 which function to indicate whether or not an alarm has occurred since that link was last manually reset. Cell 108 is comprised of left and right alarm reset mouse-activated switches 110 and 112. Cell 114 is comprised of manual mouse-activated left and right switches 116,118 which enable an operator to selectively disable alarm detection with respect to a particular link. This feature is useful, for example, to permit authorized traffic across a link on a temporary basis. Cell 120 includes six graphic indicators which comprise normal and fault status indicators for the left link, right link, and sector control section. More specifically, graphic indicators 122 and 124 respectively indicate normal and fault status for left link 68, graphic indicators 130 and 132 indicate normal and fault status for the sector control section 76, and graphic indicators 126, 128 indicate normal and fault status for right link 70. Additional link status, alarm and central station data can also be displayed on the monitor 80 in alphanumeric form.

Figure 2B:
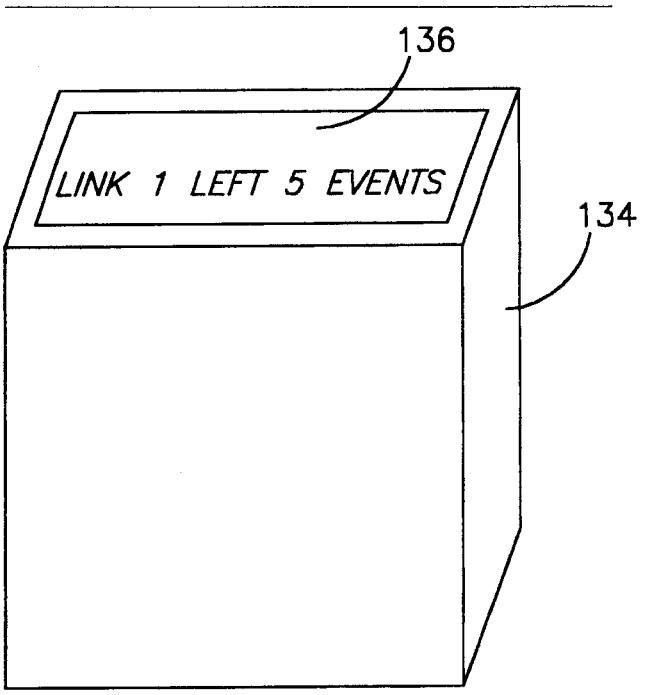

FIG. 1 additionally depicts a central remote receiver 134. The receiver 134 is preferably implemented in a pocket sized pager-type housing which can be readily carried by a person patrolling in the field. The central station transceiver 82 updates display panel 136 on receiver 134 to enable field personnel to quickly respond to an intrusion along the boundary. As depicted in FIG. 2B, the receiver 134 display panel 136 has an alphanumeric format capable of displaying alarm information and the location for any link.

Embodiments of the invention can include an arbitrary number (N) of sectors. However, in the exemplary embodiment to be discussed herein, it will be assumed that the system accommodates eight sectors unless otherwise stated, each sector defining two bistatic microwave links. As was previously pointed out, prior art systems disclose bistatic links capable of monitoring intrusion over distances up to several hundred feet. Accordingly, an eight sector, sixteen link system assumed herein is capable of monitoring a boundary up to several miles in length. Each physical module, i.e. 24,26,28 of a sector set is fully self contained, operating on its own battery supply which is charged by a solar panel, as represented in FIG. 3. The modules are constructed so that they can be readily dismantled and redeployed very quickly.

Figure 4:
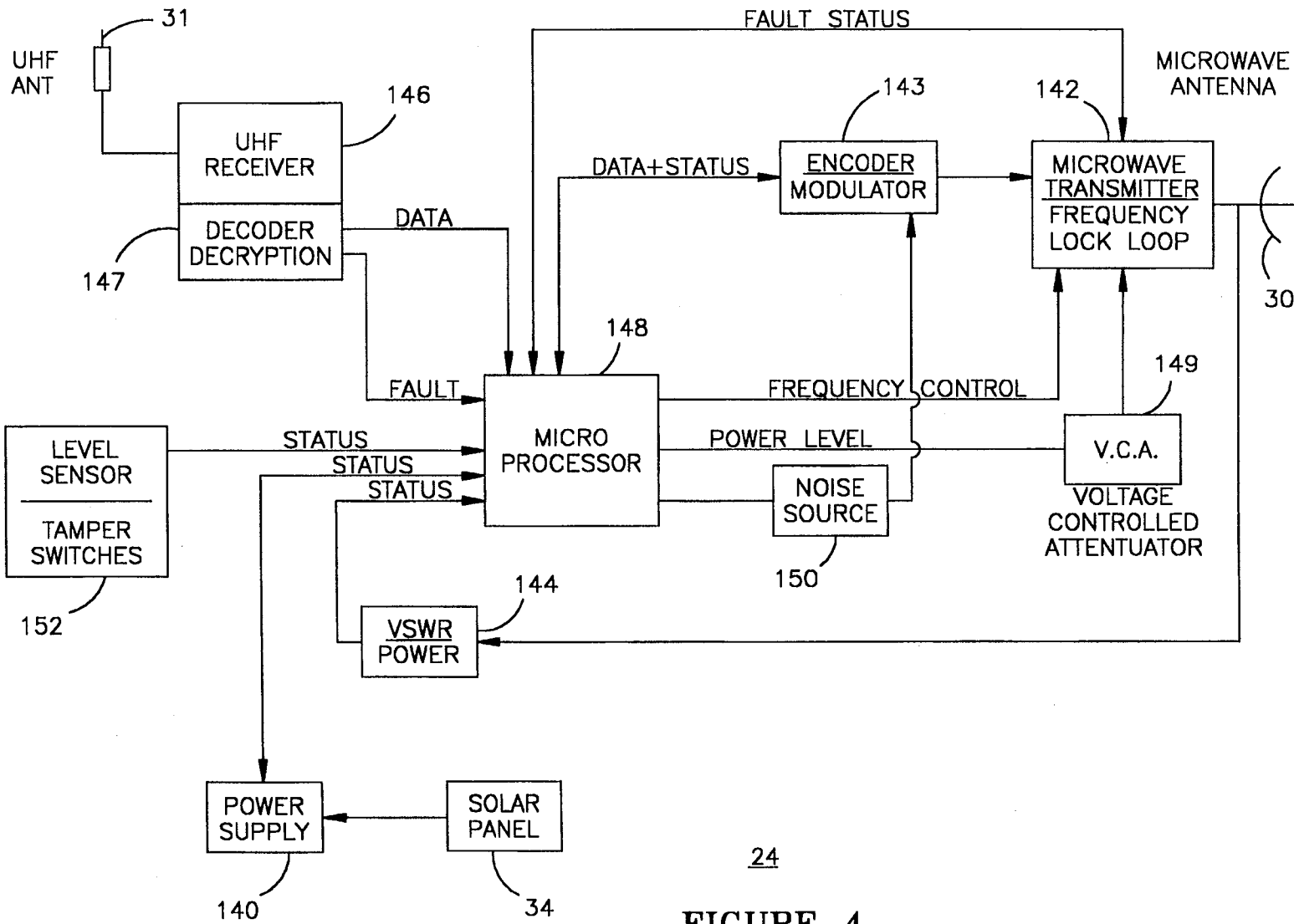
FIG. 4 is a block diagram of a preferred sector set transmit module; receive sections of a sector module.

Attention is now directed to FIG. 4 which comprises a block diagram depicting the sector set transmit module 24 which, together with sector module receive section 74 forms the left microwave link 68. The transmit module 24 includes a battery power supply 140 which is charged during daylight hours by solar panel 34. Although not specifically shown, it should be understood that all of the electronic components within transmit module 24 are powered by the battery 140. The transmit module 24 includes microwave transmitter 142 which on command from microprocessor 148 supplies a microwave carrier signal $F_c$ modulated by modulator 143 to transmit antenna 30. In accordance with the present invention, the microprocessor 148 sets the operating parameters of transmit module 24, based upon its stored program and various locally generated status inputs and data received via UHF antenna 35. Locally generated status inputs are derived from several sources including power supply 140 which includes a battery monitor which monitors the battery output voltage and provides a true output when a low battery voltage is sensed. Another locally generated status input is derived from monitor 152 which monitors any tampering or vandalism at the transmit module 24. Similarly, monitor 144 monitors the power output of microwave transmitter 142 and the condition of microwave antenna 30. Further status inputs to microprocessor 148 indicate the temperature and current drain of transmitter 142, and the temperature and current drain of UHF receiver 146. If the microprocessor 148 detects a fault condition from any of its status inputs, it will provide an appropriate fault status code to encoder/modulator 143. In addition, if the detected fault condition indicates an imminent failure, the microprocessor 148 may entirely disable the faulty unit.

In addition to locally generated status inputs, microprocessor 148 responds to signals from the central station transceiver 82 received via UHF antenna 31 and receiver 146. UHF receiver 146 detected output is presented to decoder 147 whose output data is used by microprocessor 148 to enable and set various operating parameters of microwave transmitter 142 including power level, via voltage controlled attenuator (VCA) 149, and frequency. Additionally, microprocessor 148 presents appropriate data to encoder 143 to modulate the microwave carrier, and also to periodically activate noise source 150 for the purpose of calibrating the link by generating a known noise power level which is used to adjust the threshold of the associated microwave receiver section 74.

The receive section 74 (FIG. 5) includes antenna 50 and microwave receiver 160. The received output of microwave receiver 160 is applied to signal level detector 156 which responds to a change (e.g. attenuation) in the microwave carrier along link 68. An additional output of microwave receiver 160 is presented to AM detector 154 which responds to link status encoding introduced onto the carrier by encoder 143 (FIG. 4). The outputs of detectors 154 and 156 are supplied to a sector module microprocessor 158 (which also receives corresponding inputs from the receive section 72). The microprocessor 158 functions to control both receive sections 72 and 74 in response to its stored program, its received status and alarm inputs, its locally generated status inputs, and inputs received from UHF transceiver 78 via antenna 64. More particularly, the received output of transceiver 78 is presented to decoder 170 whose output data is used by microprocessor 158 to calibrate the left and right receive sections 72 and 74 (e.g. microwave receiver sensitivity threshold, AGC threshold, and frequency) in response to a normal interrogation command from the central station transceiver 82.

Microprocessor 158 is connected to several local monitors which produce status information indicating the operational status of sector module 28. More specifically, power supply 194 includes a battery monitor which monitors the output voltage of the battery and provides a true output when a low battery voltage is sensed. In addition, monitor 172 monitors any tampering or vandalism at the sector module. Monitor 166 monitors the power output of UHF transceiver 78 and the condition of antenna 64. UHF transceiver 78 preferably also includes a monitor which responds to excessive temperature or current drain.

Microprocessor 158 uses data from the left and right receiver sections 72 and 74 (e.g. AM detector 154) to compute the bit error rate (B.E.R.) for the left and right links 68 and 70. In response to an interrogation command from the central station transceiver 82, microprocessor 158 provides data to encoder 168 representing the B.E.R. and signal attenuations for links 68 and 70, equipment status for transmit modules 24 and 26, equipment status for receiver sections 72 and 74, and the operational status of sector module 28. Transmit/-receive switch 164 responds to microprocessor 158 and changes the UHF transceiver 78 from the receive to transmit mode. Data transmitted from transceiver 78 is received by the central transceiver 82.

Figure 6:
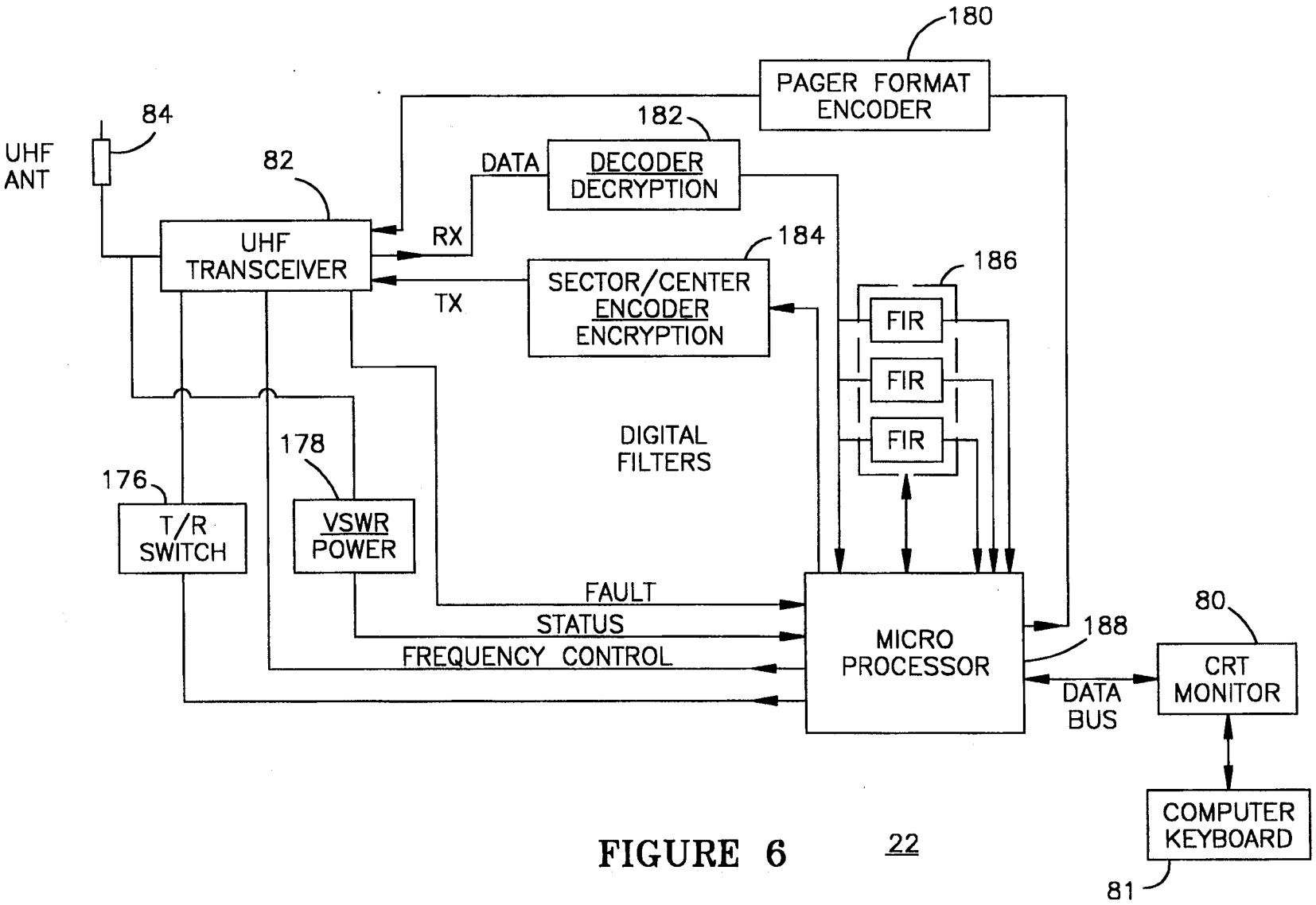
FIG. 6 is a block diagram of a preferred central station.

Attention is now directed to FIG. 6 which depicts a block diagram of a preferred central station implementation in accordance with the invention. Initially note that information displayed on the central station monitor 80 (FIG. 2A) enables the control station's operator to use computer keyboard/mouse 81 initiate various system control programs which can be interactive. For example only, the operator can initiate a sequential progression of events that repeats (i.e., a "round robin" which could, e.g., start at Sector 1 and go to Sector 1000 skipping every tenth sector) or a random progression of assigned sectors.

Once a program is initiated, transmit/receive switch 176 responds to central station microprocessor 188 and switches UHF transceiver 82 from the receive to the transmit mode. Sector left, right and center data from microprocessor 188 is encoded by sector center encoder 184 to UHF transceiver 82 and transmitted using antenna 84. The data from microprocessor 188 is typically transmitted at regular intervals and consists of global commands which synchronizes the clock signals used by transmit module and sector module microprocessors 148, 150 to the clock of central station microprocessor 188.

The system's synchronized microprocessor clocks allow the system operator to select "quiet mode" programs. In this mode, data is downloaded to the assigned sectors' sector module 28, using a single UHF transmission. The data preferably contains a time schedule for transmission of alert and status information from the sector module to the central station 22 and an assigned set of priorities for reporting status, alerts and central station 22 overrides. The "quiet mode" is used for high security applications where UHF transmissions are to be kept to a minimum. If the system is not operating in the "quiet mode", microprocessor 188 typically uses time domain multiplexing (TDM) to sequentially interrogate the multiple sector sets.

Microprocessor 188 operates in accordance with its stored programs, locally generated status inputs and status and alarm data received via UHF antenna 84. Local status inputs are produced by monitor 178 which monitors the power output of UHF transceiver 82 and antenna 84 and a monitor not shown which monitors the temperature and current drain of the transceiver 82. To make the system operational, it is preferably to first calibrate each link. This is done by the operator at the central station 22 using keyboard/mouse 81 to initiate a calibration program. The program selects a sector and link to calibrate and does so by causing microprocessor 188 to send a calibration enable command using UHF transceiver 82 and antenna 84. If sector left 24 is chosen, the calibration command is received by UHF antenna 31, receiver 146 and decoded by decoder 147, and passed along to microprocessor 148. Microprocessor 148 executes its calibration program by turning on reference noise source 150 (which generates a known noise power level) and modulator 143. Microwave transmitter 142 with antenna 30 transmits a number of noise pulses. The calibration command is also received at sector module 28 by UHF antenna 64 (FIG. 5) and UHF transceiver 78 and decoded by decoder 170 causing microprocessor 158 to execute its calibration program. The noise pulses are received by microwave antenna 50 and microwave receiver 160 and are integrated by signal level detector 156 to yield an average power level for a known number of pulses. This is used by microprocessor 158 to calibrate microwave receiver 160 by setting the receiver AGC to a reference threshold level.

In operation, using a normal interrogation sequence or a previously downloaded sequence ("quiet mode"), sector left microwave transmitter 142 is briefly enabled. Status left data is applied to the microwave carrier by burst data packet (PCM). The left microwave receiver section 160 (FIG. 5) demodulates this data. Both signal level left and status data left are passed to the microprocessor 158. After this process is repeated for sector right, microprocessor 158 uses the status left data to compute the B.E.R. for each of the left and right links. The computed B.E.R. value is related to rapid changes in link path attenuation which could, for example, be caused by environmental factors such as sandstorms, rain, or other ambient effects.

The computed bit error rates and signal attenuations for each of the left and right links 68,70, and status for the left and right links, as well as center sector module 28, are all sent to the central station 22 via UHF antennas 64, 84.

At central station 22, data received by UHF antenna 84 and UHF transceiver 82 is decoded by decoder 182. Digital signal processing using fast impulse response filter 186 is used to recursively average the data packets and B.E.R.'s.

Data from a sector module (for each link) is UHF transmitted to the central station in the form of samples of C/N (cymbol to noise) and S/N (signal to noise). The data at the central station is correlated at specific time intervals. This can be done because the interrogation is preferably under program control (i.e., round robin-sequential) and the time interval for receiving the data is predictable. Therefore, if the data is not received, there is a possible alert condition (this may be due to jamming or catastrophic failure of equipment). For each data packet (burst data) sent across a microwave link, the C/N (cymbol to noise) is calculated to produce a sample. The C/N (B.E.R.) may range from $10^0$ which is noise to $10^{-7}$, which is an ideal condition. Each data packet is further processed at the microwave receiver and the S/N (signal to noise) ratio is calculated. This represents link signal attenuation or power to noise ratio of the link. S/N samples are used for varying microwave power levels and microwave receiver parameters in order to maintain the B.E.R. at a desired level, e.g., $10^{-5}$.

At the central station, each data packet is checked to make sure it is valid (not a bogus packet introduced by someone else). This check is done by using CRC (cyclical redundancy check). A check is also made to verify whether any embedded codes (ciphers) are present. An error detection and correlation algorithm is preferably used to clean the data packet of noise. If the packet data is too badly degraded by a poor S/N, the packet is disregarded (i.e., a B.E.R. of $10^{-1}$). The samples of C/N (B.E.R.) are processed using DSP (digital signal processing) to recursively average the samples. Samples which contain time vs. amplitude information (B.E.R.) are converted by the DSP filters to yield frequency and amplitude vs. time. The output of the DSP filters 186 to the central station microprocessor 188 which performs pattern recognition based on its stored library of profiles.

Figure 9A:
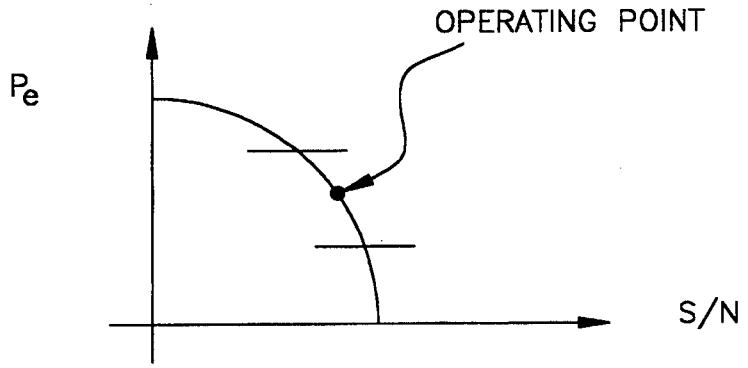
FIGS. 9A,9B, and 9C are exemplary curves respectively depicting error probability (Pe) vs. signal to noise ratio (S/N), microwave receiver automatic gain control (AGC) setting, and link error probability vs. time.

Assuming that for a given signal to noise ratio for a microwave link, a desirable link B.E.R. might be approximately $10^{-5}$, the power output of the links microwave transmitter, e.g., 142 is adjusted (e.g.,by varying the PCM rate) until the recursively averaged B.E.R. at central station microprocessor 188 is in the range of $10^{-4}$ to $10^{-6}$ (FIG. 9A). If a packet of data is missed, the process is repeated or the microwave transmitter power output is increased and then repeated until the B.E.R. is in the desired range. This process fixes the "long-term" Pe (Probability of Error) at approximately $10^{-5}$ (FIG. 9A).

The link path attenuation is a function of topographic irregularities, i.e. rocks, vegetation, shrubbery, trees, and environmental effects, e.g. weather or airborne particles. Thus the long-term Pe is a function of the link's conditions and serves to "normalize" or set a reference for each link's situation. As environment changes (e.g., rain, snow, sandstorms) the system under microprocessor control dynamically changes operating parameters of the microwave transmitter (e.g., frequency, power level) and receiver (e.g., sensitivity, bandwidth). These changes accommodate changing environmental conditions, to maintain the Pe at approximately $10^{-5}$.

In order to differentiate true alerts (path intrusions) from false alarms (e.g., changes attributable to weather conditions), acquired line data is preferably compared to a library of weather-related profiles stored at the central station microprocessor 188. These "environmental density functions" are derived by combining the path attenuation and B.E.R. vs. time profiles of random, intermittent, and continuous rain, snow, dust storms, etc. Thus, if a sudden rain squall or dust storm appears in the link's path, the long and short term path attenuation and B.E.R. vs. time data is compared to stored environmental density functions (FIG. 9C) and a false alarm is avoided.

Figure 7:
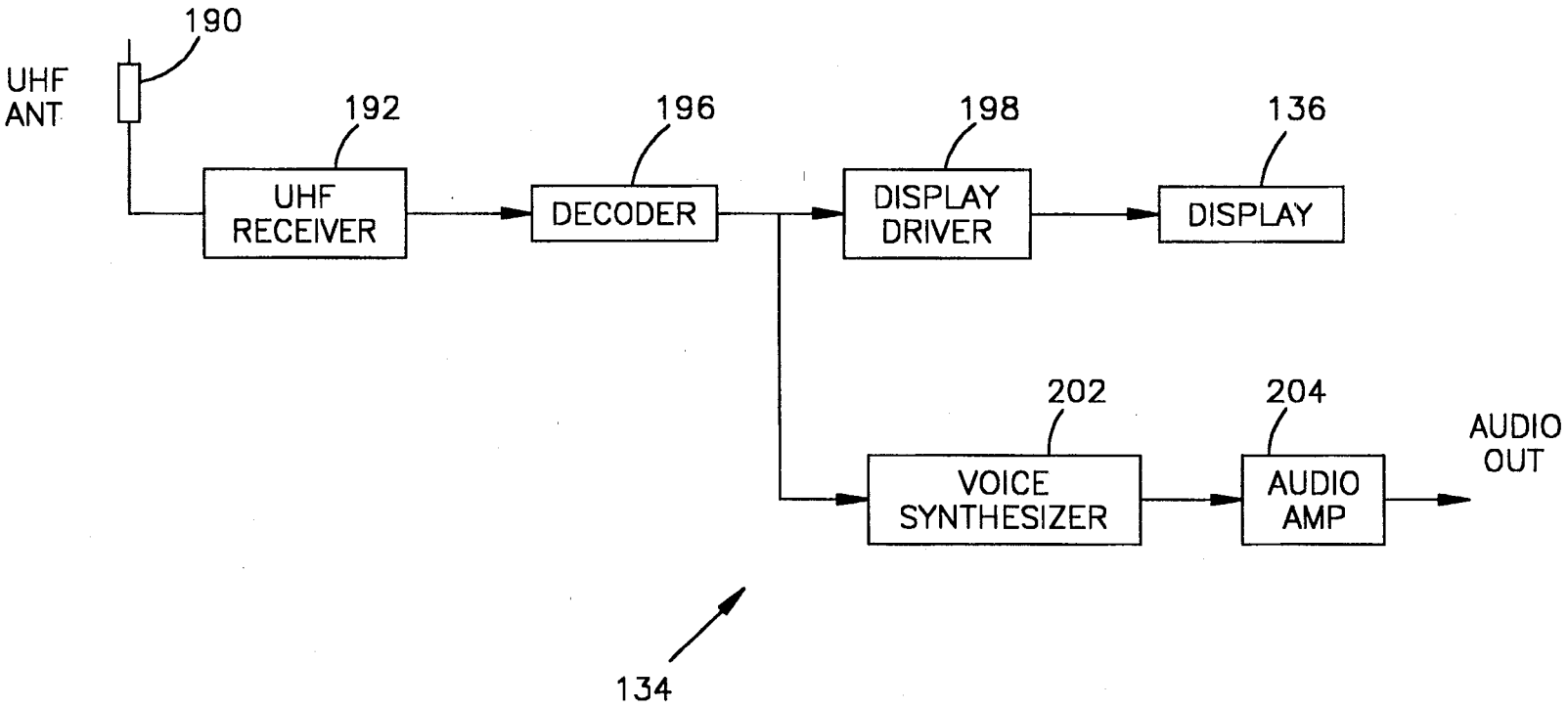
FIG. 7 is a block diagram of a preferred central station remote receiver block diagram.
Figure 8A:
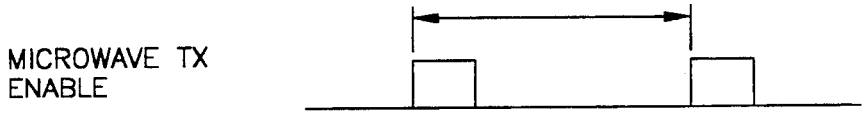
FIG. 8A is a timing diagram depicting a sector interrogation.
Figure 8B:
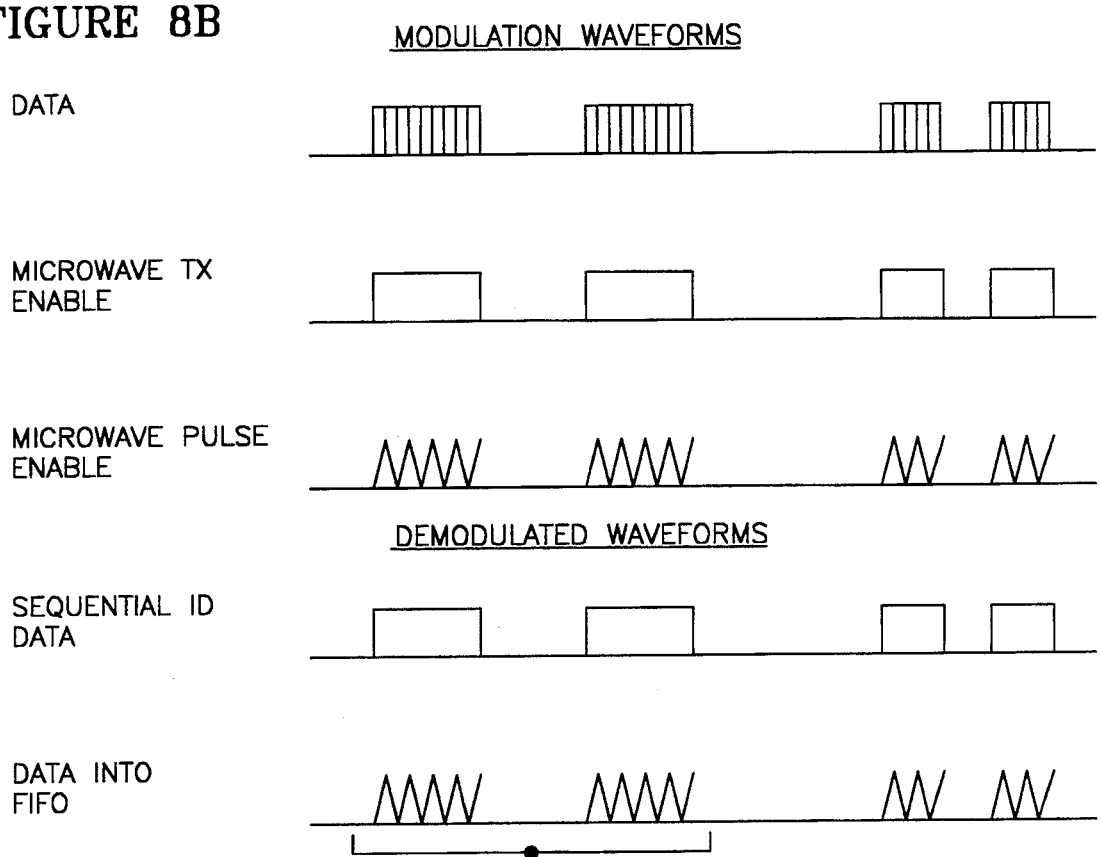
FIG. 8B is a diagram depicting data modulation of, and demodulation of, the microwave carrier.
Figure 8C:
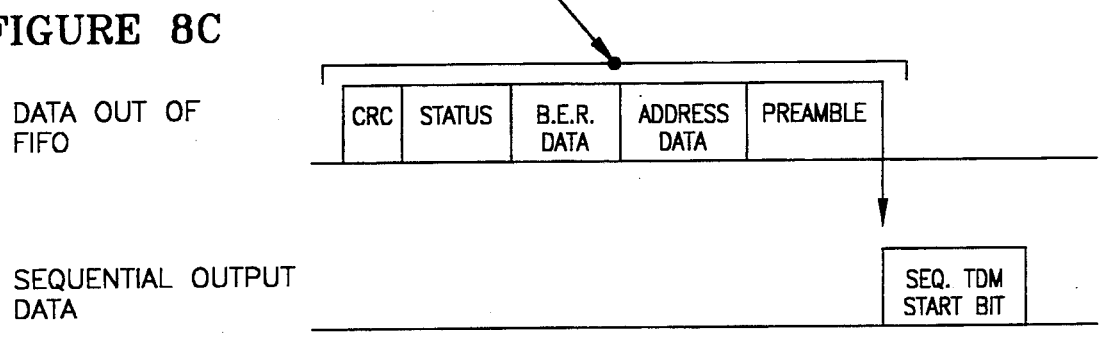
FIG. 8C is a diagram depicting data format.
Figure 9B:
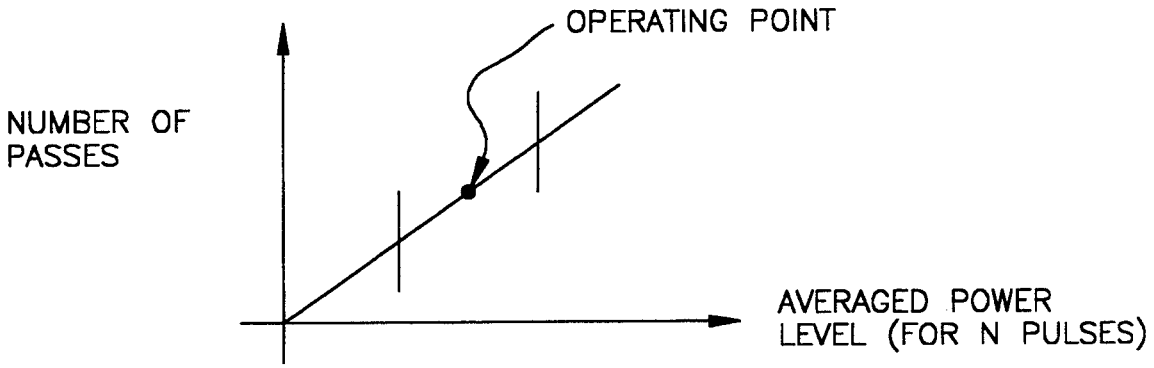
Figure 9C:
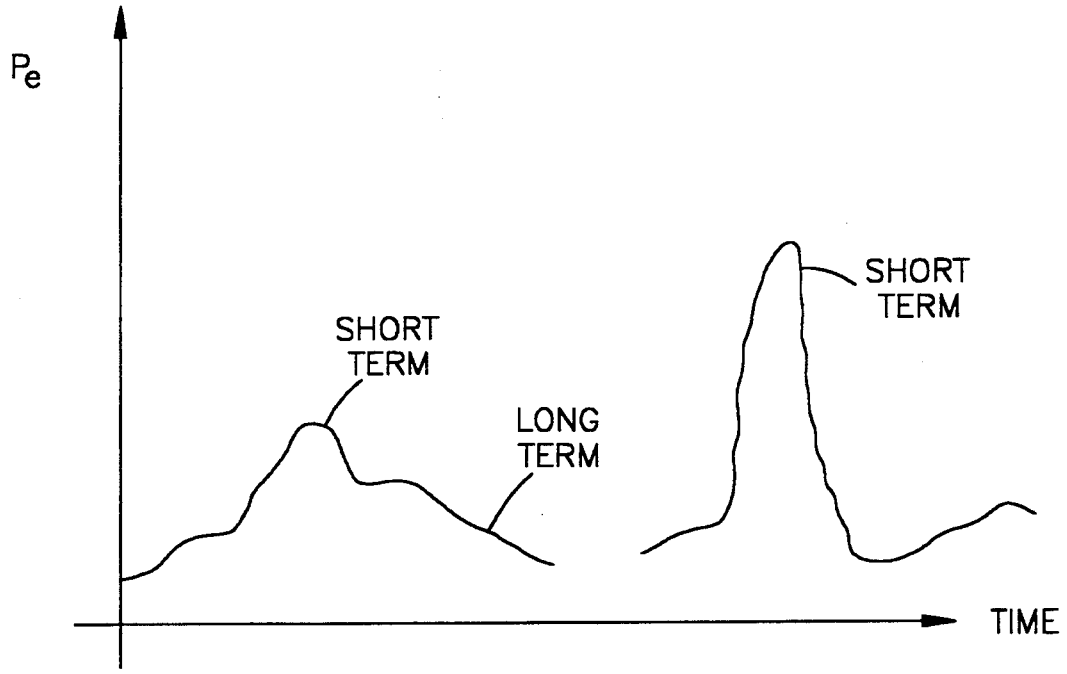

Attention is now directed to FIGS. 9A, 9B, and 9C which describe the operation of the central station depicted in FIGS. 6 and 7. If microprocessor 188 determines a true alarm or a fault status for any link, then the alarm or status data is encoded by pager format encoder 180 and transmitted by UHF transceiver 82 and UHF antenna, 84 to central station remote receiver(s) 134 in the field (FIG. 2B). Central station remote receiver 134 (FIG. 7) drives alphanumeric display 136 via display driver 198 to display alarm and status link location(s). Voice synthesizer 202 and audio amplifier 204 voice the same data the driver 198 and synthesizer 202 respond to data signals received via antenna 190 and receiver 192 and decoded by decoder 196.

From the foregoing, it will now be recognized that an intrusion detection system has been disclosed herein in which multiple bistatic links can be efficiently remotely interrogated to indicate to an operator at a central station the status and alarm condition at each link. Moreover, the central station operator is able to readily see the number of accumulated intrusions for each link. Still further, the status and alarm information for each link can be rapidly and automatically communicated to field personnel. Furthermore, the links are adaptive to changing weather conditions and are able to mask local topographical features. The central station is able to make distinctions between real targets and false alarms caused by small animals, thus avoiding false alarms.

More particularly, in accordance with the disclosed embodiment, each link's microwave transmitter and receiver parameters are adjusted under microprocessor control to maintain optimal operating points. Pulse code modulation is preferably employed to communicate status information over each microwave link and to develop a recursively averaged bit error rate to produce a normalized local terrain reference which masks existing topographical features. In order to minimize false alarms, the averaged bit error rate is compared to a library of stored computer profiles.

In order to accommodate a large number of sector (with each sector spanning 1 kilometer), polling is used to selectively interrogate each sector, utilizing Time Division Multiplexing (TDM). The sector interrogation sequence is operator-selectable. This feature offers:

1. Flexibility: Programs such as "round robin" may be used to accommodate a system with many sectors, or selective scanning of sensitive sectors may be used in vulnerable areas.

2. Power efficiency: Microwave transmitter power is "On" only on interrogation.

3. Avoiding sector-to-sector fringing effects: Only one sector is active at a time. This avoids the possibility that a transmitted field may cause falsing if more than one sector is active at a time.

4. Handshaking: Used to interrogate each sector, this full addressing capability allows encryption, thereby assuring a secure data link from central station to each sector. This is software implemented.

The interrogation protocol used in selectively polling each sector permits the remote control of several parameters: microwave transmitter duty cycle (power output); microwave receiver—AGC; sensitivity; various thresholds; frequency selection; the UHF transceiver; etc.

Although a preferred implementation of the invention has been disclosed herein, it will be recognized by those skilled in the art that various changes and modifications can be made, all falling within the intended scope of the appended claims.

I claim:

1. An intrusion detection system comprising:

a plurality of microwave links, each of said links is defined by an operationally coupled microwave transmitter and microwave receiver, deployed to define a detection boundary;

said microwave transmitter being operable in accordance with defined transmitter operating parameters, said transmitter operating parameters include at least one of transmitter frequency and power output, and including an antenna for transmitting a microwave carrier signal and a status encoder for applying status information to said carrier signal representative of the operational status of said transmitter;

said microwave receiver being operable in accordance with defined receiver operating parameters, said receiver operating parameters include at least one of receiver frequency, filter function and power output, and including an antenna oriented to receive said microwave carrier signal from the transmitter operationally coupled thereto, a processor for producing an alarm output responsive to an intrusion across the link associated with said receiver and a status decoder for producing a status output representative of the operational status of the transmitter operationally coupled thereto;

central station means located remote from said microwave receiver and in wireless communication therewith for receiving information therefrom representative of said alarm output, said status output, and s communication error rate across said link;

said central station means including processor means responsive to said received information for remotely adjusting said operating parameters of said microwave transmitter and said microwave receiver;

said central station means including means for displaying the alarm outputs produced for each link.

2. The system of claim 1 wherein said central station means includes RF transmitter means; and wherein said microwave transmitter and said microwave receiver each have an RF receiver coupled thereto; and wherein said central station processor means remotely adjusts said microwave transmitter operating parameters and said microwave receiver operating parameters via RF signal transmissions from said central station RF transmitter to said microwave transmitter and microwave receiver RF receivers.

3. The system of claim 2 wherein said central station processor means remotely adjusts at least one said microwave transmitter frequency and said power output and at least one of said microwave receiver frequency and said sensitivity to increase the probability of intrusion detection and reduce the probability of false alarms.

4. The system of claim 1 wherein said status encoder applies said status information to said carrier signal in data packet bursts.

5. The system of claim 4 wherein said microwave receiver processor includes means responsive to said data packet bursts for determining the bit error rate of the microwave link associated with said receiver.

6. The system of claim 5 wherein said central station means includes RF transmitter means; and wherein said microwave transmitter and said microwave receiver each have an RF receiver coupled thereto; and wherein said central station processor means remotely adjusts said microwave transmitter and microwave receiver operating parameters in response to said determined bit error rate via RF signal transmission from said central station RF transmitter to said microwave transmitter and microwave receiver RF receivers.

7. The system of claim 6 wherein said transmitter operating parameters include transmitter frequency and power output and said receiver operating parameters include receiver frequency and sensitivity; and wherein said central station processor means remotely adjusts said microwave transmitter frequency and/or power output and said microwave receiver frequency and/or sensitivity to increase the probability of intrusion detection and reduce the probability of false alarms.

8. An intrusion detection system comprising:

a plurality of sector sets, each of said sector sets including a sector module and first and second transmit modules located remotely from said sector module;

said sector module including first and second receive sections, each of said receive sections having a receive antenna adapted to be microwave coupled to said first and second transmit modules, respectively, to define left and right microwave links;

each of said transmit modules being operable in accordance with defined transmitter operating parameters, said transmitter operating parameters include at least one of transmitter frequency and power output, and having (1) a transmit antenna and transmitter means connected thereto for transmitting a microwave carrier, (2) means for applying status information to said carrier representative of the operational status of that transmit module, and (3) an RF receiver means for receiving information from a remotely located site for adjusting the operational status of that transmit module;

each of said receive sections being operable in accordance with defined receiver operating parameters, said receiver operating parameters include at least one of receiver frequency, filter function and power output, and including processor means for producing alarm information responsive to an intrusion across the link associated with that receive section, status information representative of the operational status of the transmit module coupled thereto, and bit error rate information representative of the quality of communication across the link;

said sector module further including means for producing status output information representative of the operational status of each of said receive sections;

central station means; and wherein said sector module includes RF transmitter means for generating an RF carrier and means for applying said alarm and status information to said carrier for transmission to said central station means.

9. The system of claim 8 wherein said central station means includes processor means responsive to said bit error rate information for adjusting the operating parameters of said transmit modules and said receive sections.

10. The system of claim 8 wherein said sector module and said first and second transmit modules each includes rechargeable battery means; and wherein each of said modules includes solar panel means for charging said battery means.

* * * * *